US005158201A

United States Patent [19]

Bartlow

[11] Patent Number: 5,158,201

[45] Date of Patent: Oct. 27, 1992

[54] STORAGE TANK HAVING SECONDARY CONTAINMENT

[75] Inventor: David H. Bartlow, Conroe, Tex.

[73] Assignee: Owens-Corning Technology, Inc., Summit, Ill.

[21] Appl. No.: 833,287

[22] Filed: Feb. 10, 1992

Related U.S. Application Data

[63] Continuation-in-part of Ser. No. 596,189, Oct. 12, 1990, abandoned.

[51] Int. Cl.[5] ..... B65D 90/04

[52] U.S. Cl. ..... 220/565; 220/469; 220/445; 73/49.2

[58] Field of Search ..... 220/565, 403, 461, 469, 220/445, 723, 721; 73/49.2 T

[56] References Cited

U.S. PATENT DOCUMENTS

| | | | |
|---|---|---|---|
| 4,523,454 | 6/1985 | Sharp | 220/449 |
| 4,524,609 | 6/1985 | Sharp | 220/723 |
| 4,625,892 | 12/1986 | Carlin, Jr. | 220/461 |
| 4,640,439 | 2/1987 | Palazzo | 220/445 |
| 4,821,915 | 4/1989 | Mayer | 220/445 |
| 4,920,786 | 5/1990 | Danielson | 220/403 |
| 4,989,447 | 2/1991 | Gelin | 220/445 |
| 5,039,367 | 8/1991 | Sharp | 220/469 |
| 5,072,623 | 12/1991 | Hendershot | 220/403 |

*Primary Examiner*—Stephen Marcus
*Assistant Examiner*—S. Castellano
*Attorney, Agent, or Firm*—Ted C. Gillespie

[57] ABSTRACT

An underground storage tank having secondary containment comprising a self-supporting, semi-rigid thin wall located on the inside of the tank. The thin inner wall completely lines the inside of the tank and is structurally independent of the tank.

20 Claims, 3 Drawing Sheets

STORAGE TANK HAVING SECONDARY CONTAINMENT

This application is a continuation-in-part of Ser. No. 07/596,189 filed on Oct. 12, 1990 and now abandoned.

TECHNICAL FIELD

This invention generally relates to storage tanks and more particularly to underground storage tanks with secondary containment.

BACKGROUND ART

Environmental protection is becoming increasingly important. As our understanding of contamination of soil and water beneath the surface grows, our efforts to prevent leaks increases. Early efforts resulted in glass fiber reinforced plastic (hereinafter "FRP", single wall underground tanks, as described in U.S. Pat. No. 3,661,294 issued in 1972. As our awareness grew, our efforts to protect the environment matured into glass fiber reinforced plastic double-wall underground tanks, often equipped with leak detection systems, as described in U.S. Pat. No. 4,561,292 issued in 1985.

Others have attempted to encase or fit rigid storage tanks with secondary containment systems, often with flexible bladders or jackets, as described in U.S. Pat. No. 4,524,609 issued in 1985. Flexible bladders have obvious problems. For example, flexible inner bladders or flexible outer jackets are very susceptible to damage from cutting, tearing, puncturing, etc. Further, they require support, either through hoops or other mechanical features or by a vacuum system.

DISCLOSURE OF THE INVENTION

My invention is a standard rigid, self-supporting single wall tank (SWT) on the inside of which I have added an inner wall. The inner wall has sufficient flexibility so that it will substantially collapse, which means that the inner wall would collapse an amount more than about 5 percent of its manufactured diameter when totally unconstrained by the single wall tank. However, the inner wall has sufficient rigidity to substantially conform to the shape of the tank when the inner wall is positioned within the single wall tank. This means that the inner wall would remain at a height of at least 90 percent of its manufactured diameter, prior to any attachment of the inner wall to the tank by fittings, when positioned within the tank.

In a preferred embodiment of the invention the inner wall would collapse an amount more than about 10 percent of its manufactured diameter when totally unconstrained, but would remain at a height of at least 95 percent of its manufactured diameter when positioned within the tank. Most preferably, the inner wall would collapse an amount more than about 25 percent of its manufactured diameter when totally unconstrained, but would remain at a height of at least 98 percent of its manufactured diameter when positioned within the tank.

In yet another embodiment of the invention, the inner wall is structurally independent of the tank meaning it is not attached to single wall tank. The annular space between the inner and outer wall may have a non-structural porous core such as a thin HDPE fluid transmitting net. Of course, even though the inner wall is structurally independent of the tank the inner wall and tank are to be joined where necessary, such as by fittings and the like. For the most part, however, the inner wall and the tank are totally unconnected and not rigidly attached.

The novelty of my invention is a self-supporting, semi-rigid, thin wall inside the tank. The inner wall can be a thin FRP wall, thin stainless steel or an equivalent material. As I will show, carbon steel inner tanks and flexible bladders do not compare with my discovery.

The thin wall I employ is self-supporting. Flexible bladders on the other hand require either internal supports or the application of a vacuum between the inner bladder and the outer tank.

The tank of the invention has many advantages. One is that the installer can field test the outer wall for leaks prior to installation. Jacketed tanks cannot be field soap tested. Also, in the event of a breach to the primary tank, the FRP outer wall will permeate only negligible amounts of fuel into the environment, as opposed to a jacket which, because of its low resistance to fuel permeation, could allow a significant fuel spill prior to detection.

The thin wall I use has low permeability. This is important in that some leak sensors that are located between the 2 walls will false alarm if the rate of permeation is too great. This is particularly a challenge for any material that must contain alcohol or blends of fuel containing alcohol.

The thin walls I use provide corrosion resistance for the internal wall of primary tanks. Carbon steel often rusts due to water condensate at the bottom of the tank. This has been traditionally overcome by using thick steel (at least ¼"). This is why thin carbon steel will not work, i.e. an allowance for corrosion must be incorporated into carbon steel tanks.

BRIEF DESCRIPTION OF THE DRAWINGS

The invention is more fully explained with reference to the accompanying drawings in which.

DETAILED DESCRIPTION OF THE INVENTION

Figure 1:
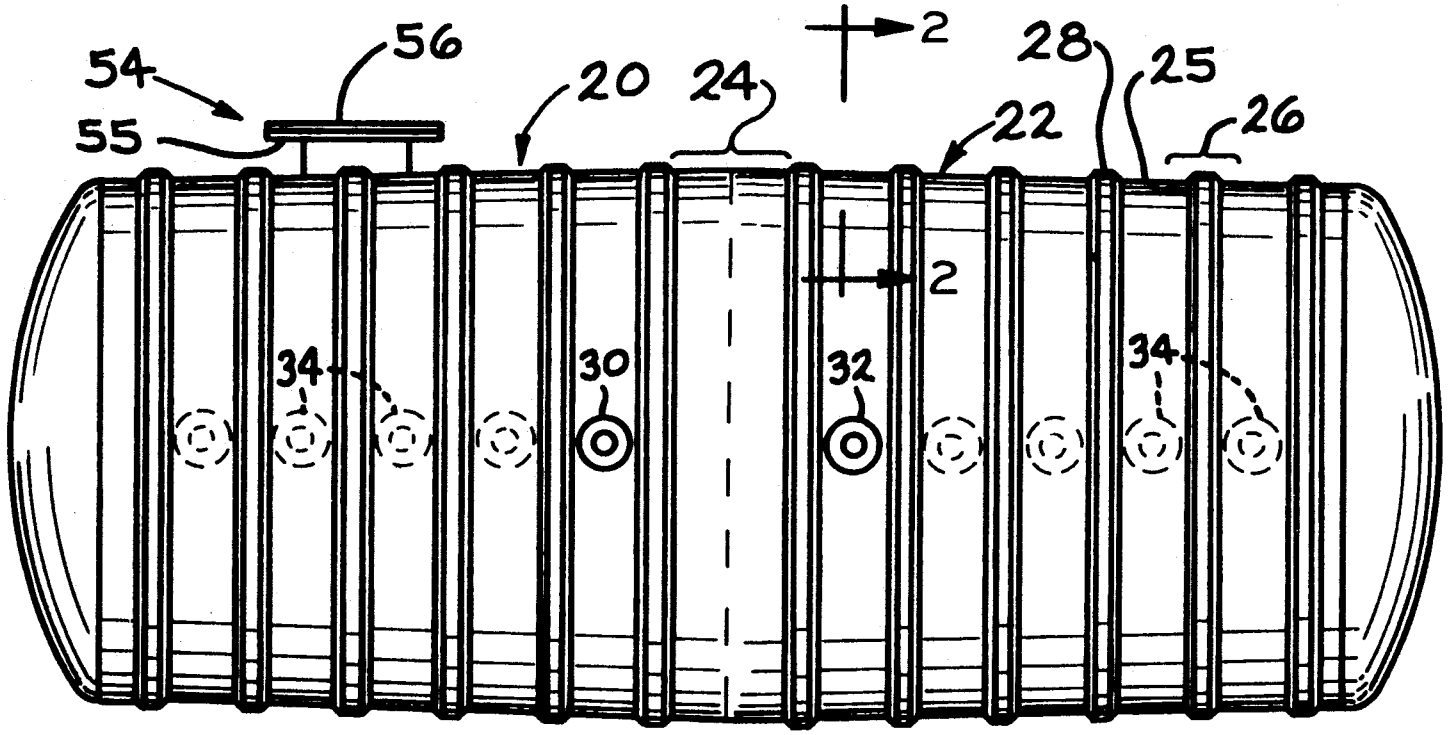
FIG. 1 is a schematic view in elevation of a single wall tank containing an FRP wall in accordance with the present invention.

FIG. 1 shows a tank 20 which employs the FRP inner wall structure of the present invention (not shown). The tank 20 is made up of opposed frusto-conical tank halves 22, connected together by center joint 24. Wall 26 includes a wall element 25 in combination with a rib 28. Actually, a plurality of ribs 28 is axially spaced along the length of the tank 20. Ribs 28 extend peripherally of the tank 20 and act in the nature of strong hoops against radially inwardly crushing forces. Since they are of high tensile strength, they also absorb tensile stresses to which the tank 20 may be subjected. It is important to note that the ribs 28 add to the stiffness of the wall 25; also, they provide protective buffers during handling.

The ribs 28 are spaced apart a sufficient distance so that fill and vent fittings 30 and 32 can be installed between the ribs. Optional positions 34 for fittings are thus provided all along the length of the tank 20. In an actual 6,000-gallon capacity tank of 8 feet nominal diameter, and approximately 20 feet length, a spacing of 16½ inches between rib enters was employed and this provided adequate space for the installation of the fittings 30 and 32.

U.S. Pat. No. 3,661,394 fully describes ribbed, single wall tank construction.

Figure 2:
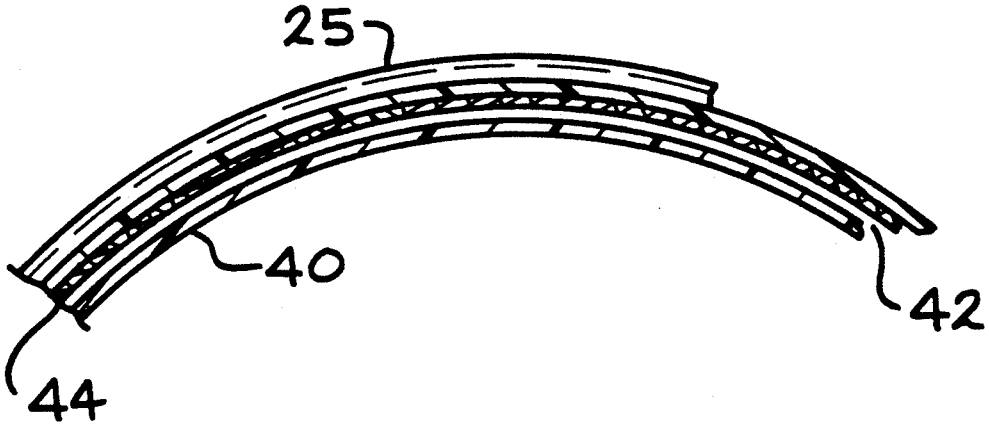
FIG. 2 is a sectional view taken generally along the line 2—2 of FIG. 1.

FIG. 2 shows FRP inner wall 40 on the inside of wall element 25. FIG. 2 also shows annular space 42 between wall 40 and wall element 25. Space 42 is partially filled with porous core 44.

Figure 3:
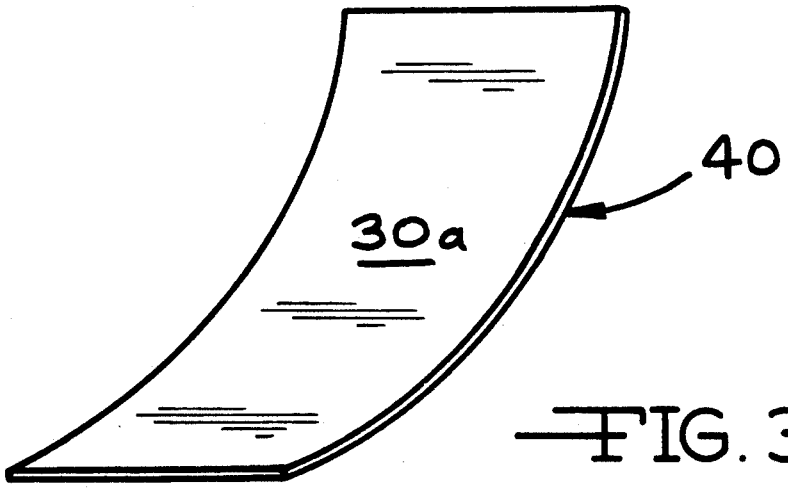
FIG. 3 is a fragmentary perspective of an FRP inner wall panel in accordance with this invention.

FIG. 3 shows a panel of FRP inner wall 40 detached from tank 20.

Typically, one can use any molding process or spray up equipment to make FRP inner wall or wall 40. One can achieve this by placing mold release (Mylar) on a conventional SWT mold, spraying up thin FRP inner wall 40 including end cap, curing the FRP, placing another sheet of Mylar on top of wall 40 and then carrying out the conventional construction of SWT, for example, as described in U.S. Pat. No. 3,661,394.

FRP inner wall 40 preferably is made of unsaturated polyester compounds. The practice of this invention, however, is not restricted to unsaturated polyesters.

These compositions, intended to polymerize when molded under heat and pressure, are generally combined with fillers and chopped glass, to produce products having appearance surfaces with a minimum of irregularities.

The use of chopped glass as reinforcement in such molding compounds is well known. The chopped glass is produced in the form of individual strands which are sized, gathered into rovings, chopped to the desired length and incorporated into the resin composite prior to molding.

The sizes generally comprise a lubricant, film formers and the like and are extremely important in imparting to the reinforcing glass its ability to be wetted out by the molding compound. These sizes are also important in that they protect the glass during handling subsequent to the sizing operation. Sizes are also influential in minimizing the amount of fuzz and fly which is produced on the glass, the fuzz and fly having a decided negative effect upon the appearance of the surface of the molded product.

The sized glass fibers generally are employed as reinforcement for sheet molding compounds (SMC) and bulk molding compounds (BMC).

Unsaturated polyesters useful in this invention typically contain a polyesterification product of one or more ethylenically unsaturated dicarboxylic acids or anhydrides such as maleic or fumaric with one or more glycols such as ethylene or propylene glycol and, sometimes, minor proportions of other aromatic or aliphatic mono- or dicarboxylic acids or anhydrides and/or other mono- or polyhydroxyl compounds. They also typically contain an ethylenically unsaturated monomer, such as styrene, copolymerizable with the unsaturated polyester for curing.

The glass fibers preferably are "E" glass fibers, well known to those skilled in the art, as described in U.S. Pat. No. 2,334,961.

As I stated above, porous core material 44 may fill space 42. Examples of porous core materials 44, are mattings, nets, screens, and meshes. Specific examples are high density polyethylene (HDPE) net, jute, polyurethane foam, polyester foam, fiberglass matting, cotton matting, nylon matting and corrugated cardboard. In the alternative, the annular space 42 may be filled with a thin separator layer, such as a layer of wax or a ¼ to 2 mil thick film of mylar. Such a separator layer would preclude adherence of the inner wall to the tank and enable communication of leaked fluid to the sensors by capillary action.

INDUSTRIAL APPLICABILITY

The following table summarizes the advantages of my invention over other alternatives:

TABLE

THIN WALL FRP INNER TANKS VS OTHER ALTERNATIVES

| | INVENTION | | CONTROL | | |
|---|---|---|---|---|---|
| | THIN FRP INNER WALL | STAINLESS STEEL 1/10" | CARBON STEEL 1/4" | CARBON STEEL 1/10" | FLEXIBLE RUBBER-LIKE BLADDER |
| Self-Supporting | Yes | Yes | Yes | Yes | No |
| Low Permeability to Fuels | Yes | Yes | Yes | Yes | No |
| Internal Wall of Primary Containment Corrosion-Resistant to Alcohol Blend. Fuels. Water | Yes | Yes | No | No | No |
| External Wall of Primary Containment Corrosion Resistant to Water | Yes | Yes | No | No | Yes |
| Independent (unconnected) From Outer Wall | Yes | Yes | Yes | Yes | Yes |
| Able to Determine the location of leaks | Yes | Yes | Yes | Yes | No |

In an alternative embodiment, inner wall 40 comprises an assemblage of inner wall sections or panels 30*a* small enough to fit inside a tank through manway openings. Typically the panels are up to 8 feet in length and range from 2 to 4 feet in width.

After the panels are in place inside the tank, one uses a hand lay-up procedure on the seams of each panel to form FRP inner wall 40.

Basically, the procedure involves building up a combination of chopped glass fibers and a hardenable liquid resin and, if desired, a sand filler.

Complete wetting of the chopped glass fibers is desirable and can be accomplished, as is well known in the art, by rolling out the resin and glass and sand mixture. After the seams are fabricated, heat or the passage of time cures the resin. One can use any spray device or combination of spray devices to apply the resin and chopped glass fibers. Often the resin contains an accelerator or catalyst to speed up the curing process.

As shown in FIG. 3, the panels making up FRP inner wall 40 preferably have the same curvature as wall element 25. Preferably inner FRP wall 40 is thin and typically is ⅛ to ¼ of an inch thick.

Access to the inside of the tank 20 is provided by a flanged manway fitting 54 (FIG. 1) communicating with the inside of the tank, and a double-flanged extension 55 normally covered by a cover 56. Hand lay-up secures manway fitting 54 to tank 20 by application of hardenable resin, chopped glass strand and filler such as sand. The hand lay-up procedure is much the same as that used to connect the panels of FRP inner wall 40. The thin FRP inner wall that I use is unique in that it is:

Self Supporting

Corrosion resistant

Of low permeability

Figure 4:
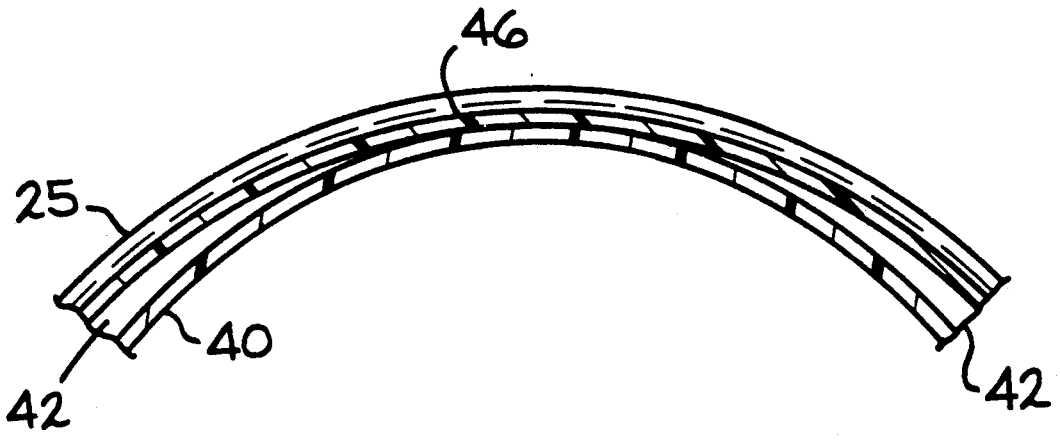
FIG. 4 is a schematic sectional view of the upper portion of the tank and inner wall where the inner wall is bonded at the top of the rigid primary tank.
Figure 5:
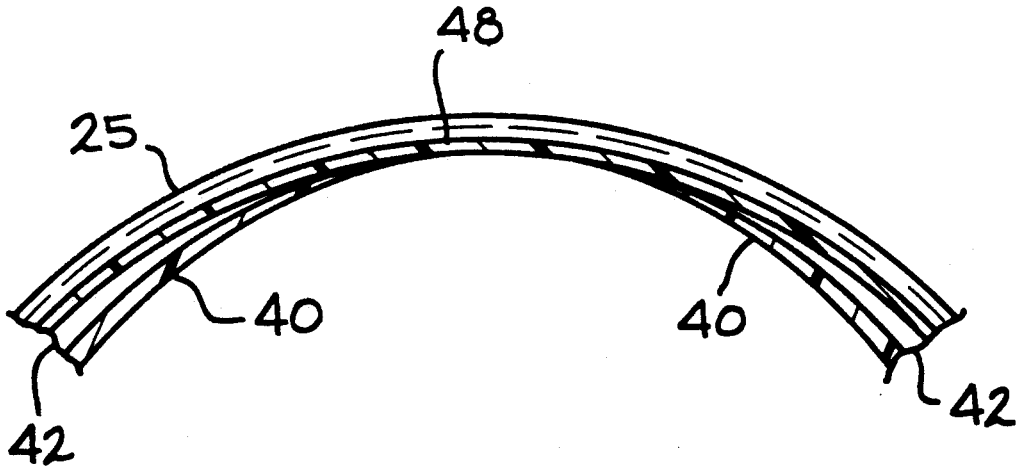
FIG. 5 is a schematic sectional view of the upper portion of the tank and inner wall where the inner wall ends near the top of the tank.

In one embodiment, the thin inner wall is structurally independent of the tank for the entire circumference except for a narrow width centered at the top of the tank. For these narrow widths, the inner wall is bonded to the rigid primary tank, thus allowing easy manufacture and installation of tank accessories such as fittings and manways. FIG. 4 shows inner wall 40 bonded to the tank 25 at the top 46. Alternately, the inner wall can end near the top of the tank resulting in only one wall at the top of the tank. FIG. 5 shows inner wall 40 ending near top 48 of the tank wall element 25.

I claim:

1. An underground storage tank comprising:

a rigid tank particularly suited for use underground; and an inner wall located on the inside of said rigid tank, the inner wall being formed from a material so that the inner wall has sufficient flexibility such that it would substantially collapse if totally unconstrained by said rigid tank, but having sufficient rigidity such that it would substantially conform to the shape of said rigid tank and essentially retain such shape when positioned within said rigid tank.

2. The tank of claim 1 wherein the inner wall is structurally independent of said rigid tank.

3. The tank of claim 2 wherein an annular space exists between said rigid tank and the inner wall.

4. The tank of claim 3 including gas porous material in the annular space between said rigid tank and the inner wall.

5. The tank of claim 4 wherein the gas porous material is a high density polyethylene net.

6. The tank of claim 3 wherein said material is glass fiber reinforced plastic.

7. The tank of claim 2 wherein said material is glass fiber reinforced plastic from 0.020" to 0.250" thick.

8. The tank of claim 2 wherein said material is metallic material from 0.010" to 0.125" thick.

9. The tank of claim 3 including a thin separator layer between said rigid tank and the inner wall.

10. The tank of claim 1 wherein the inner wall would collapse an amount more than about 10 percent of its manufactured diameter when totally unconstrained, but would remain at a height of at least 95 percent of its manufactured diameter when positioned within said rigid tank.

11. The tank of claim 10 wherein the inner wall is structurally independent of said rigid tank.

12. The tank of claim 11 wherein the inner wall would collapse an amount more than about 25 percent of its manufactured diameter when totally unconstrained, but would remain at a height of at least 98 percent of its manufactured diameter when positioned within said rigid tank.

13. The tank of claim 11 wherein an annular space exists between said rigid tank and the inner wall.

14. The tank of claim 13 including gas porous material in the annular space between said rigid tank and the inner wall.

15. The tank of claim 14 wherein the gas porous material is a high density polyethylene net.

16. The tank of claim 11 wherein said material is glass fiber reinforced plastic.

17. The tank of claim 11 wherein said material is glass fiber reinforced plastic from 0.020" to 0.250" thick.

18. The tank of claim 11 wherein said material is metallic material from 0.010" to 0.125" thick.

19. The tank of claim 8 wherein said material is stainless steel.

20. The tank of claim 18 wherein said material is stainless steel.

* * * * *